United States Patent [19]

Dufournet et al.

[11] Patent Number: 4,996,398

[45] Date of Patent: Feb. 26, 1991

[54] MEDIUM TENSION CIRCUIT BREAKING HAVING HIGH NOMINAL CURRENT

[75] Inventors: Denis Dufournet, Bron; Michel Perret, Tramole, both of France

[73] Assignee: GEC Alsthom SA, Paris, France

[21] Appl. No.: 525,589

[22] Filed: May 21, 1990

[30] Foreign Application Priority Data

May 19, 1989 [FR] France ..... 89 06554

[51] Int. Cl.[5] ..... H01H 33/88

[52] U.S. Cl. ..... 200/148 A; 200/148 R

[58] Field of Search ..... 200/148 A, 148 R

[56] References Cited

U.S. PATENT DOCUMENTS 3,271,548 9/1966 Kesselring ..... 200/148 A

FOREIGN PATENT DOCUMENTS 0011542 5/1980 European Pat. Off. .
0028039 5/1981 European Pat. Off. .
2604702 1/1977 Fed. Rep. of Germany .
1458334 10/1966 France .
2519470 7/1983 France .
2554273 5/1985 France .

*Primary Examiner*—Robert S. Macon
*Attorney, Agent, or Firm*—Surghue, Mion, Zinn, Macpeak & Seas

[57] ABSTRACT

A dielectric blast gas circuit breaker comprising a main fixed contact, a main arcing contact, and moving equipment including, in particular, a moving arcing contact and blast means, wherein the circuit breaker includes a moving main contact which is disunited from the moving equipment and which is implemented by means of a short cylindrical element associated with means communicating a speed thereto during circuit breaking which is lower than the speed of the moving equipment. The invention is applicable to medium tension circuit breakers having a high nominal current, such as the circuit breakers used in a power station.

4 Claims, 1 Drawing Sheet

MEDIUM TENSION CIRCUIT BREAKING HAVING HIGH NOMINAL CURRENT

The present invention relates to a circuit breaker having a dielectric blast gas, and more particularly to a medium tension circuit breaker through which a high value of current flows (several thousand amps). This type of circuit breaker is to be found in power stations at alternator outlets and upstream from voltage-raising transformers.

BACKGROUND OF THE INVENTION

In this type of circuit breaker, the permanent moving contact through which the permanent current flows is generally a copper tube of relatively large mass which, during a circuit-breaking operation, is driven at high speed in conjunction with an arcing contact. A large amount of energy is required for this operation since the energy requirement is proportional to the product of the mass of the moving equipment multiplied by the square of the speed at which the equipment is displaced. All manufacturers seek to reduce this operating energy since its large size penalizes the cost of the equipment for operating the circuit breaking device.

An object of the invention is to provide a circuit breaker in which both the mass and the displacement speed of the moving contact during a circuit-breaking operation are reduced compared with a prior art contact, while nevertheless maintaining a high displacement speed for the arcing contacts.

This result is obtained by disuniting the moving main contact from the moving equipment and by implementing the moving main contact as a short element associated with displacement means communicating a speed thereto during a circuit breaking operation which is less than the speed of said moving equipment.

SUMMARY OF THE INVENTION

The invention thus provides a dielectric blast gas circuit breaker comprising a main fixed contact, a main arcing contact, and moving equipment including, in particular, a moving arcing contact and blast means, wherein the circuit breaker includes a moving main contact which is disunited from said moving equipment and which is implemented by means of a short cylindrical element associated with means communicating a speed thereto during circuit breaking which is lower than the speed of the moving equipment.

In a first embodiment, the said short cylindrical element is a tube.

In another embodiment, the said short cylindrical element is constituted by rods disposed along some of the generator lines of a cylinder.

Advantageously, the said displacement means is a spring having a first end bearing against a fixed abutment and a second end bearing against an abutment fixed to said short cylindrical element.

BRIEF DESCRIPTION OF THE DRAWING

An embodiment of the invention is described by way of example with reference to the accompanying drawing, in which.

DETAILED DESCRIPTION

Figure 1:
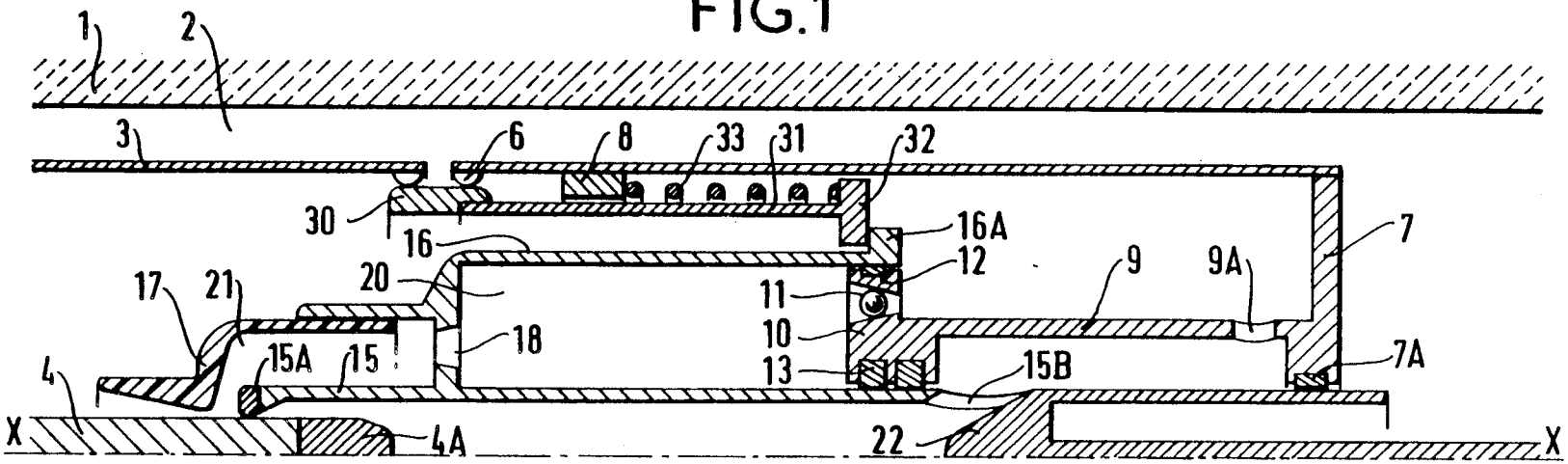
FIG. 1 is a fragmentary diagrammatic axial half section view through a circuit breaker of the invention shown in the engaged position.

The circuit breaker shown in part in FIG. 1 in half-section on the axis xx, comprises an insulating shell 1 delimiting a volume 2 filled with a gas having good dielectric properties such as sulfur hexafluoride (SF6) at a pressure of a few bars.

The fixed assembly comprises a fixed main contact constituting by fingers 3 and a fixed arcing contact constituted by a tube 4 having an end 4A made of an alloy that withstands the effects of arcing, e.g. an alloy based on tungsten. The contacts 3 and 4 are connected to a first current terminal (not shown). The fixed assembly also includes a ring of fingers 6 carried by a fixed ring 7. The fingers 6 carry an annular abutment 8 disposed on the inside of the ring of fingers. The fixed ring is electrically connected to a second current terminal (not shown).

The fixed ring 7 carries a tube 9 which is machined about the axis xx and which is terminated by a piston 10 provided with a non-return valve 11, a sealing ring 12, and sliding electrical contacts 13.

The moving equipment includes an arcing contact constituted by a tube 15 about the axis xx and having one end **15*a*** made of a material which withstands the effects of arcing.

The tube 15 is fixed to a coaxial tube 16 and together therewith it defines a blast cylinder which moves relative to the fixed piston 10. Sealing between the piston 10 and the cylinder 16 is provided by sealing ring 12. Current flows between the tube 15 and the piston 10 via the sliding contacts 13. The tube 16 carries a blast nozzle made of insulating material.

The tubes 15 and 16 are advantageously integrally formed in the same machined part. Holes 18 provided in the portion interconnecting the two tubes serve to establish communication between the volume 20 and the volume 21 lying between the tube 15 and the nozzle 17.

The tube 15 is extended by a part 22 connected to a drive rod (not shown). Holes 15B through the tube 15 and holes 9A through the tube 9 serve to evacuate hot gas into the volume 2 during a circuit breaker opening operation.

The moving main contact is constituted by a short metal cylinder 30 co-operating with the fingers 3 and 6. This cylinder is fixed to the end of a tube 31 which is terminated by a ring 32. (In a variant, the tube could be replaced by a set of rods disposed along some of the generator lines of a cylinder.)

A spring 33 which is compressed when the circuit breaker is in the engaged position (FIG. 1) is disposed between the annular abutment 8 and the ring 32.

Figure 2:
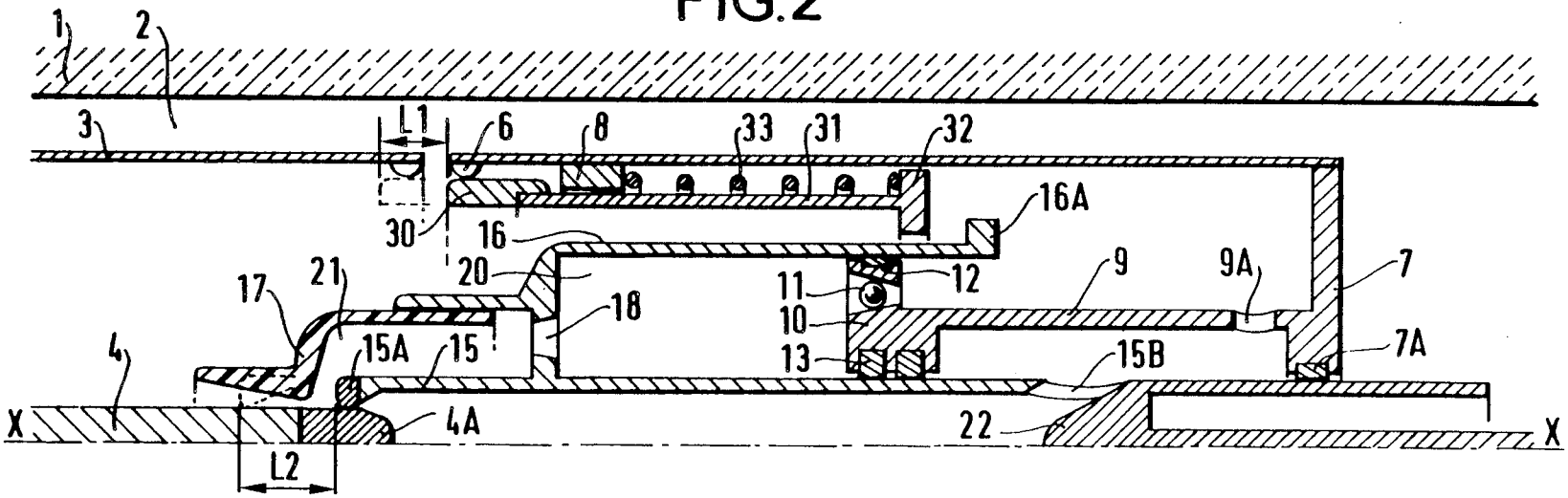
FIG. 2 is a fragmentary diagrammatic axial half-section view of the same circuit breaker during a circuit breaking operation.

The circuit breaker operates as follows:

in the engaged position (FIG. 1) current flows via the fingers 3, the tube 30, the fingers 6 and the ring 7;

when the circuit breaker opens (FIG. 2), the tube 22 is driven at high speed (V2) to the right in the figure.

The tube 30 leaves the fingers 3 at a lower speed (V1) which is the speed given by the energy in the spring 33.

While the main contact 30 is leaving the fingers 3 and travelling a distance L1 at the speed V1, the moving contacts move relative to each other over a distance L2 which is greater than L1 at a speed V2 which is greater than the speed V1.

After the main contacts 3 and 30 have separated, current flows via the tubes 4, 15, the contacts 13, the tube 9, and the ring 7.

The remainder of the opening operation (arc blasting) takes place in the same way as in well-known arc blast circuit breakers. By opening, the valve 11 prevents any suction effect occurring in the volume 30 during an engagement operation.

By replacing the conventional permanent contact in accordance with the invention by a contact which is disunited from the moving equipment, a major saving in moving equipment weight is achieved (with the weight being reduced to about ⅓rd of the weight in prior art circuit breaker of the same type). Simultaneously, the speed of the moving main contact is reduced and this achieves a considerable saving in the energy required for operating the circuit breaker.

In the example described, a spring is used as an example of the means for implementing the moving arcing contact. Another possibility would be to use a set of levers connected to the moving equipment in a manner well known to the person skilled in the art.

It may be observed that the invention is also applicable to circuit breakers provided with means for establishing a secondary arc which is used to assist in blasting the main arc and/or in providing circuit breaking drive.

We claim:

1. A dielectric blast gas circuit breaker comprising a main fixed contact, a main arcing contact, and moving equipment including, in particular, a moving arcing contact and blast means, wherein the circuit breaker includes a moving main contact which is disunited from said moving equipment and which is implemented by means of a short cylindrical element associated with means communicating a speed thereto during circuit breaking which is lower than the speed of the moving equipment.

2. A circuit breaker according to claim 1, wherein the said short cylindrical element is a tube.

3. A circuit breaker according to claim 1, wherein the said short cylindrical element is constituted by rods disposed along some of the generator lines of a cylinder.

4. A circuit breaker according to claim 1, wherein the said displacement means is a spring having a first end bearing against a fixed abutment and a second end bearing against an abutment fixed to said short cylindrical element.

* * * * *